US010320131B2

(12) United States Patent
Zhang et al.

(10) Patent No.: US 10,320,131 B2
(45) Date of Patent: Jun. 11, 2019

(54) RECESSED SWITCHED TEST CONNECTOR

(71) Applicant: Microsoft Technology Licensing, LLC, Redmond, WA (US)

(72) Inventors: Chen Zhang, Sammamish, WA (US); Toby Morris, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/628,427

(22) Filed: Jun. 20, 2017

(65) Prior Publication Data

US 2018/0366888 A1 Dec. 20, 2018

(51) Int. Cl.

| | |
|---|---|
| ***H01R 29/00*** | (2006.01) |
| ***H01R 24/50*** | (2011.01) |
| ***H01R 13/703*** | (2006.01) |
| *H01R 13/74* | (2006.01) |
| *H01R 24/44* | (2011.01) |

(52) U.S. Cl.

CPC ..... *H01R 24/50* (2013.01); *H01R 13/703* (2013.01); *H01R 13/7031* (2013.01); *H01R 13/74* (2013.01); *H01R 24/44* (2013.01); *H01R 2201/20* (2013.01)

(58) Field of Classification Search

CPC ... H01R 2103/00; H01R 12/57; G01R 1/0425

USPC ..... 439/63, 83, 188, 581, 912

See application file for complete search history.

(56) References Cited

U.S. PATENT DOCUMENTS

| | | | | |
|---|---|---|---|---|
| 5,180,315 | A | 1/1993 | Nagashima | |
| 5,702,271 | A * | 12/1997 | Steinman | H01R 24/64 439/676 |
| 5,997,314 | A * | 12/1999 | Wallace | H01R 24/50 439/63 |
| 6,024,585 | A * | 2/2000 | Mickievicz | H01Q 7/00 343/702 |
| 6,533,610 | B1 * | 3/2003 | Dai | H01R 24/50 439/581 |
| 6,607,400 | B1 * | 8/2003 | Ko | H01R 24/50 439/578 |
| 6,700,464 | B2 | 3/2004 | Ling et al. | |
| 6,847,813 | B2 | 1/2005 | Ashley et al. | |
| 7,182,610 | B2 * | 2/2007 | Lin | H01R 12/707 439/567 |

(Continued)

FOREIGN PATENT DOCUMENTS

EP 0951209 A2 10/1999

OTHER PUBLICATIONS

"Microcoaxial-connector / wiretoboard / straight / elbow", http://www.directindustry.com/prod/molex/product-11614-553623.html, Retrieved on: Dec. 2, 2016, 7 pages.

(Continued)

*Primary Examiner* — Thanh Tam T Le

(74) *Attorney, Agent, or Firm* — Holzer Patel Drennan

(57) ABSTRACT

Circuit boards incorporating one or more wireless communication components are often subjected to certification testing during commissioning. A test port is often included within each circuit board to perform the certification testing. The presently disclosed recessed test connectors reduce or eliminate protrusion of the test port on a non-component side of the circuit board, while still providing access to the test port from the non-component side of the circuit board.

19 Claims, 5 Drawing Sheets

(56) References Cited

U.S. PATENT DOCUMENTS

| | | | | |
|---|---|---|---|---|
| 7,648,394 | B2 | 1/2010 | Yotsutani | |
| 7,748,997 | B2 * | 7/2010 | Hamner | H01R 12/712 439/607.01 |
| 8,221,137 | B2 * | 7/2012 | Zheng | H01R 13/6581 439/80 |
| 8,747,153 | B2 * | 6/2014 | Takano | H01R 12/718 439/582 |
| 8,905,781 | B2 * | 12/2014 | Chen | H01R 13/627 439/581 |
| 9,196,981 | B2 * | 11/2015 | Shimoji | H01R 12/7076 |
| 9,219,306 | B2 | 12/2015 | Song et al. | |
| 9,397,432 | B2 * | 7/2016 | Yukutake | H01R 13/46 |
| 9,961,774 | B2 * | 5/2018 | Supinski | H05K 1/18 |
| 2010/0248503 | A1 | 9/2010 | Kang et al. | |
| 2013/0171876 | A1 | 7/2013 | Funahashi | |
| 2016/0149318 | A1 | 5/2016 | Lee et al. | |
| 2016/0223589 | A1 | 8/2016 | Duong et al. | |

OTHER PUBLICATIONS

"Coaxial connector / straight / snap-on / micro-miniature-max. 6 GHz, 50-75 Ω | MCX series—TE", http://www.directindustry.com/prod/te-connectivity-connectors/product-66409-1378477.html, Retrieved on: Dec. 2, 2016, 8 pages.

* cited by examiner

View A-A

View B-B

RECESSED SWITCHED TEST CONNECTOR

BACKGROUND

Modern computing devices incorporate increasingly complex and compact circuit boards, which may incorporate various wireless communication components (e.g., Wi-Fi, Bluetooth, and long-term evolution (LTE) components) amongst other electronic components. In various implementations, the wireless communication components may need to be calibrated, compliance tested (e.g., comply with Federal Communications Commission (FCC) emissions standards), inspected for further product development, and/or interference tested (collectively referred to herein as certification testing).

A test port is often included within each circuit board to perform the certification testing during commissioning of an associated device. However, such test ports typically protrude from a component-side of the circuit board, but are inaccessible once a screen is attached to the device. Alternatively, some test ports protrude from a side of the circuit board opposite the circuit board components (i.e., the non-component side). However, these test ports may create physical interference issues with other nearby components of the computing device (e.g., the device case).

SUMMARY

Implementations described and claimed herein provide a printed circuit board comprising a substrate including an aperture, an array of components attached to a first side of the substrate, and a recessed switched test connector oriented within the aperture. The recessed switched test connector includes a test port accessible from a second side of the substrate and a bracket securing the recessed switched test connector within the aperture.

Implementations described and claimed herein further provide a method of using a recessed switched test connector. The method includes inserting a test probe into a test port of the recessed switched test connector and testing a circuit connected from the recessed switched test connector to the test probe for interference. Further, the recessed switched test connector is oriented within an aperture in a printed circuit board substrate and the recessed switched test connector is accessible from a side of the substrate opposite an array of printed circuit board components attached to the substrate.

Implementations described and claimed herein still further provide a computing device comprising a printed circuit board, a display, and a case. The printed circuit board includes a substrate including an aperture, an array of components attached to a first side of the substrate, and a recessed switched test connector oriented within the aperture. The recessed switched test connector includes a test port accessible from a second side of the substrate and a bracket securing the recessed switched test connector within the aperture. The display resides in close proximity to the first side of the substrate. The case resides in close proximity to the second side of the substrate and includes a test aperture axially aligned with the test port permitting access to the test port from outside the computing device.

Other implementations are also described and recited herein. This Summary is provided to introduce a selection of concepts in a simplified form that are further described below in the Detailed Descriptions. This Summary is not intended to identify key features or essential features of the claimed subject matter, nor is it intended to be used to limit the scope of the claimed subject matter.

BRIEF DESCRIPTIONS OF THE DRAWINGS

DETAILED DESCRIPTIONS

Increasingly smaller computing devices necessitate other components of a computing device to be mounted very close to the circuit board and conventional test ports can become a limiting factor. The presently disclosed recessed test connectors reduce or eliminate protrusion of the test port on a non-component side of a printed circuit board, while providing access to the test port from the non-component side of the printed circuit board.

Figure 1:
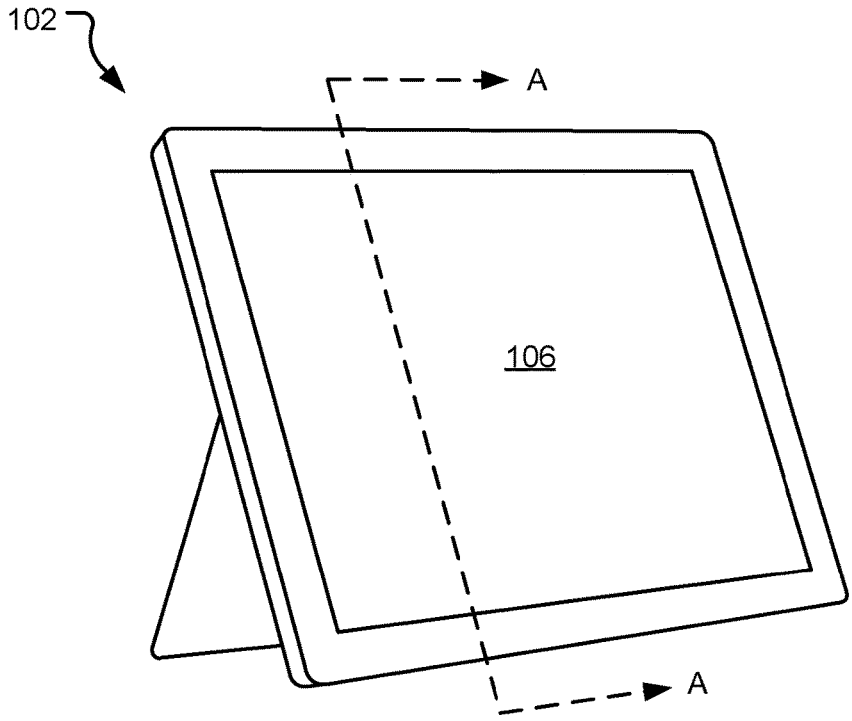
FIG. 1 illustrates a tablet computer and an elevation sectional view of an associated printed circuit board incorporating an example recessed switched test connector.
Figure 1:
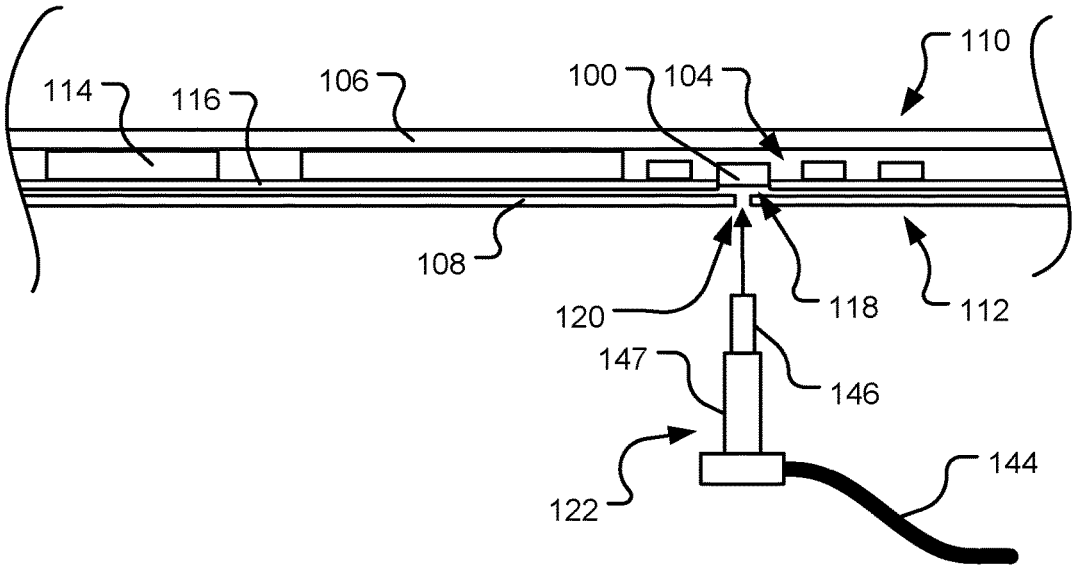

FIG. 1 illustrates a tablet computer 102 and an elevation sectional view A-A of an associated printed circuit board (PCB) 104 incorporating an example recessed switched test connector 100. The tablet computer 102 includes a display 106 (e.g., a touchscreen, liquid crystal (LCD), light-emitting diode (LED), or organic light-emitting diode (OLED) screens) occupying a front-facing portion of the tablet computer 102 and a case 108 occupying a rear-facing portion of the tablet computer 102. The display 106 and the case 108 in combination encompass the printed circuit board 104 within the tablet computer 102. View A-A of the tablet computer 102 is a cross section cut along section lines A-A.

The printed circuit board 104 includes a variety of electronic components (e.g., component 114), which may be microprocessors, integrated circuits, resistors, transistors, capacitors, electronic storage devices, and/or cooling components. The electronic components are mounted on a component side (or first side) 110 of the circuit board 104 and soldered or otherwise electrically connected to a network of conductive tracks, pads, and other conductive features. The conductive network is etched from one or more conductive sheets laminated onto a non-conductive substrate 116. As a result, the component side 110 of the substrate 116 includes protruding electronic components, while a non-component side (or second side) 112 of the substrate 116 contains few, if any, protruding components.

The recessed switched test connector 100 resides within an aperture 118 in the printed circuit board 104. The recessed switched test connector 100 protrudes beyond the substrate 116 on the component side 110 of the substrate 116, but does not substantially protrude beyond the substrate 116 (e.g., the recessed switched test connector 100 is substantially flush with an outer surface of the substrate 116 or is set back into the substrate 116) on the non-component side 112 of the substrate 116. Further, a test port (not shown, see e.g., test port 232 of FIG. 2) of the recessed switched test connector 100 is oriented facing the case 108. In various implementations, a magnitude that the various components of the printed circuit board 104 protrude beyond the substrate 116 on the component side 110 of the substrate 116 is greater than the magnitude that the recessed switched test connector 100 protrudes beyond the substrate 116 on the component side 110 of the substrate 116.

The display 106 resides in close proximity to (i.e., within 3.00-4.00 mm, or less) or in contact with the printed circuit board 104 on its component side 110. The case 108 resides in close proximity to (i.e., less than 0.25 mm) or in contact with the printed circuit board 104 on its non-component side 112. For comparison, in traditional switched connectors the display 106 and/or the case 110 may be spaced 0.80-1.00 mm from the printed circuit board 104. The case 108 further includes a test aperture 120 that is axially aligned with the test port so that a user may access the test port from the exterior of the tablet computer 102 to perform certification testing (e.g., calibration, compliance testing (e.g., compliance with Federal Communications Commission (FCC) emissions standards), inspection for further product development, and/or interference testing). In various implementations, the certification testing accesses or sends a RF signal via the recessed switched test connector 100.

A user may selectively insert an associated test probe 122 through the test aperture 120 and into the test port to perform the certification testing on the tablet computer 102. The recessed switched test connector 100 is automatically activated when the test probe 122 is inserted into the test port and de-activated when the test probe 122 is removed from the test port. More specifically, an electrical circuit runs through the recessed switched test connector 100 during normal operation of the tablet computer 102. When the test probe 122 is inserted into the test port, the test probe 122 mechanically and electrically disrupts the electrical circuit and diverts a signal running through the electrical circuit to the test probe 122 for the certification testing and analysis. When the test probe 122 is removed from the test port, the electrical circuit is mechanically and electrically returned to its original condition where the electrical circuit runs through the recessed switched test connector 100.

In various implementations, an impedance of the test port may substantially match an impedance of the test probe 122, which in turn may substantially match an impedance within an associated coaxial cable 144. Impendence may be affected by the cross sectional area of a central conductor 146 and an outer conductor 147 of each of the test probe 122 and the coaxial cable 144, as well as the distance between the two conductors 146, 147 and the material selection for each of the conductors 146, 147. In various implementations, a substantially matching impedance has less than 5% variation in diameter. As a result, there may be little to no impedance change along a length of the test probe 122.

In some implementations, the test aperture 120 is covered (e.g., with a friction-fit plug, not shown) after the certification testing on the tablet computer 102 is complete. The plug may prevent contaminates from entering the test aperture 120 when the tablet computer 102 is placed into service and may provide an improved visual or tactile experience to an end user by hiding the test aperture 120 from the end user.

While the tablet computer 102 is shown and described in detail above, the printed circuit board 104 and the recessed switched test connector 100, or other recessed switched test connectors described herein, may be incorporated into a variety of other computing devices (e.g., laptop computers, personal computers, gaming devices, smart phones, or other devices that carry out one or more specific sets of arithmetic and/or logical operations) with a variety of physical forms, including various sizes and shapes.

Figure 2:
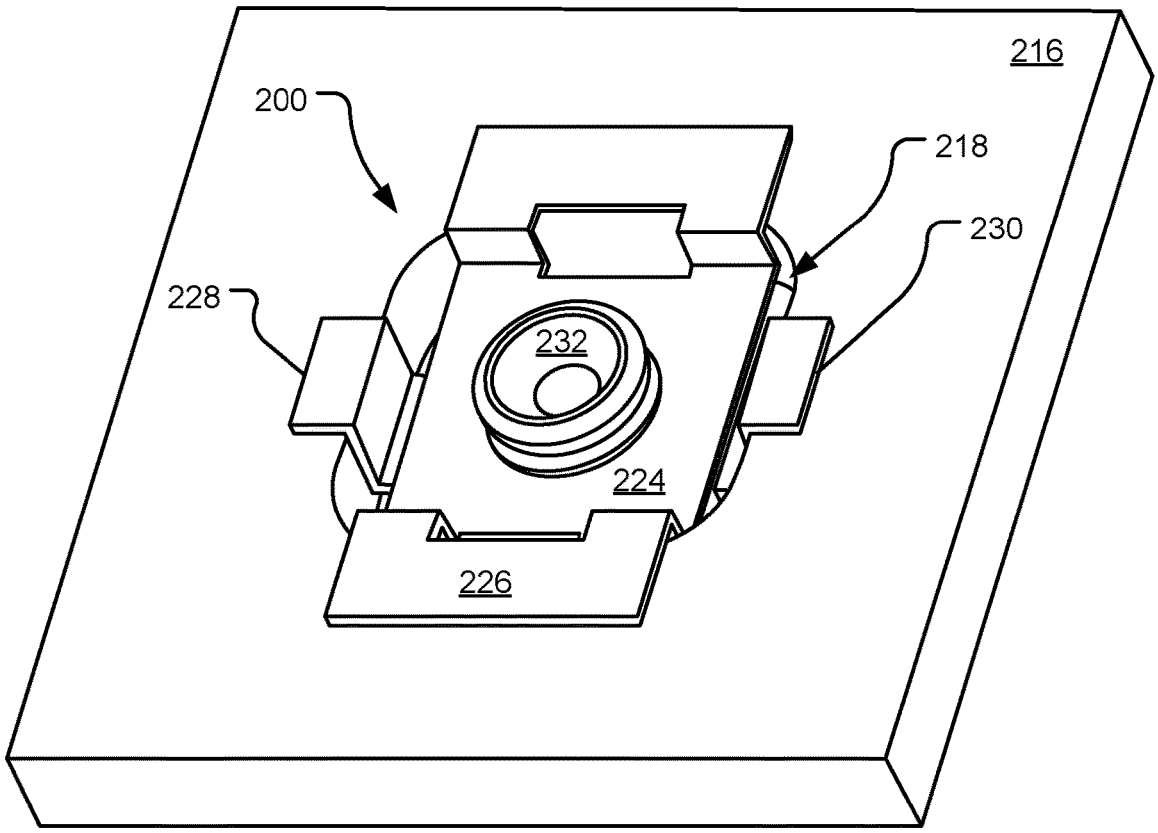
FIG. 2 is a first perspective view of an example recessed switched test connector.

FIG. 2 is a first perspective view of an example recessed switched test connector 200. The recessed switched test connector 200 resides within an aperture 218 in a substrate 216 of an associated printed circuit board. The recessed switched test connector 200 protrudes beyond the substrate 216 on a component side (not shown) of the substrate 216, but does not substantially protrude beyond the substrate 216 (e.g., the recessed switched test connector 200 is substantially flush with an outer surface of the substrate 216 or is set back into the substrate 216) on the depicted non-component side of the substrate 216.

The recessed switched test connector 200 includes a test port 232 facing the non-component side of the substrate 216. The test port 232 is used for selectively inserting a test probe (not shown, see e.g., test probe 122 of FIG. 1) to perform certification testing and analysis on the printed circuit board. The recessed switched test connector 200 is automatically activated when the test probe is inserted into the test port 232 and de-activated when the test probe is removed from the test port 232. More specifically, an electrical circuit runs through the recessed switched test connector 200 between tabs 228, 230 during normal operation of the printed circuit board. When the test probe is inserted into the test port 232, the test probe mechanically and electrically disrupts the electrical circuit and diverts a signal running through the electrical circuit to the test probe for performing the certification testing and analysis. Depending on the direction of current flow, this disrupted signal may run from either tab 228 or tab 230 to the test probe. When the test probe is removed from the test port 232, the electrical circuit is mechanically and electrically returned to its original condition where the electrical circuit runs through the recessed switched test connector 200.

The recessed switched test connector 200 further includes a mounting bracket 224, which mounts the recessed switched test connector 200 to the depicted non-component side of the substrate 216 via one or more mounting tabs (e.g., tab 226) and physically secures the recessed switched test connector 200 in place. The mounting tabs are soldered, adhered, or mechanically fastened to the substrate 216 and the mounting bracket 224 forms an integral part of the recessed switched test connector 200. In some implementations, the mounting bracket 224 also serves as an electrical ground for the recessed switched test connector 200 and is electrically connected to ground on the printed circuit board.

Figure 3:
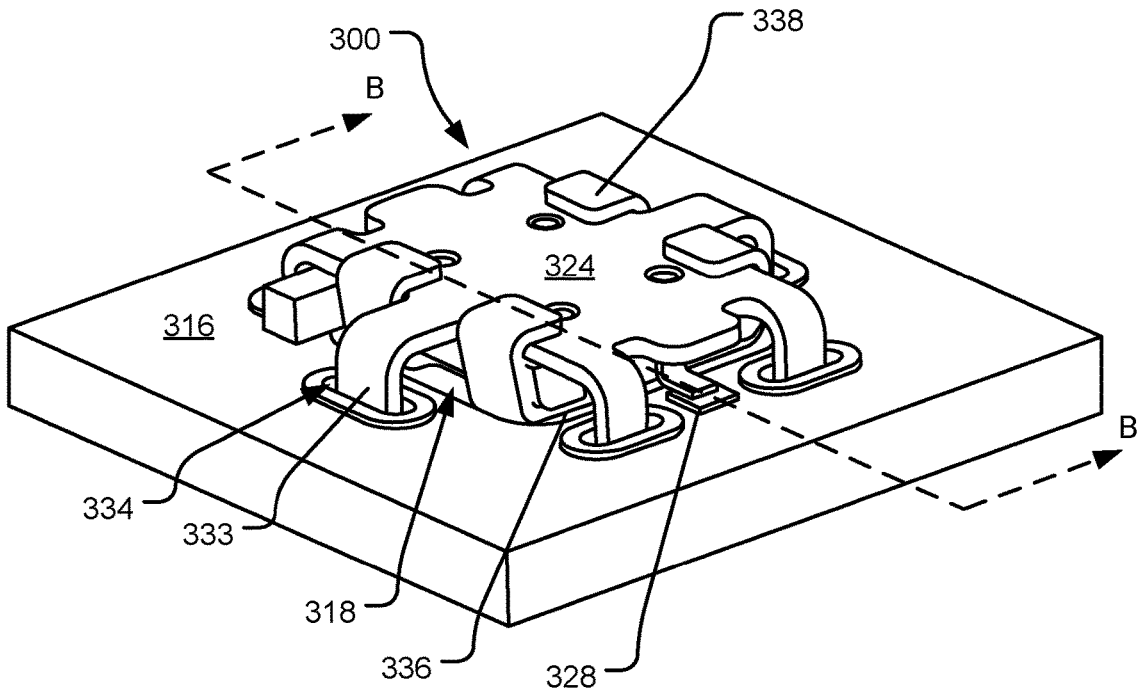
FIG. 3 is a second perspective view of an example recessed switched test connector.

FIG. 3 is a second perspective view of an example recessed switched test connector 300. The recessed switched test connector 300 resides within an aperture 318 in a substrate 316 of an associated printed circuit board. The recessed switched test connector 300 protrudes beyond the substrate 316 on the depicted component side of the substrate 316, but does not substantially protrude beyond the substrate 316 (e.g., the recessed switched test connector 300 is substantially flush with an outer surface of the substrate 316 or is set back into the substrate 316) on a non-component side (not depicted) of the substrate 316.

The recessed switched test connector 300 includes a test port (not shown) facing the non-component side of the substrate 316. The test port is used for selectively inserting a test probe (also not shown, see e.g., test probe 122 of FIG. 1) to perform certification testing and analysis on the printed circuit board. The recessed switched test connector 300 is automatically activated when the test probe is inserted into the test port and de-activated when the test probe is removed from the test port. More specifically, an electrical circuit runs through the recessed switched test connector 300 between two tabs (e.g., tab 328) during normal operation of the printed circuit board. When the test probe is inserted into the test port, the test probe mechanically and electrically disrupts the electrical circuit and diverts a signal running through the electrical circuit to the test probe for performing the certification testing and analysis. Depending on the direction of current flow, this disrupted signal may run from either of two tabs electrically connecting the recessed switched test connector 300 to the test probe. When the test probe is removed from the test port, the electrical circuit is mechanically and electrically returned to its original condition where the electrical circuit runs through the recessed switched test connector 300 via the tabs.

The recessed switched test connector 300 further includes a mounting bracket 324, which mounts and physically secures the recessed switched test connector 300 to the substrate 316. The mounting bracket 324 includes an array of stanchions (e.g., stanchion 333) that extend through respective holes (e.g., hole 334) in the substrate 316 and may terminate with plain ends or tabs on the non-component side of the substrate 316. The tabs or plain ends of the stanchions are soldered, adhered, or mechanically fastened to the substrate 316 (on either or both of the component side and the non-component side) and the mounting bracket 324 forms an integral part of the recessed switched test connector 300. In some implementations, the mounting bracket 324 also serves as electrical ground for the recessed switched test connector 300 and is electrically connected to ground on the printed circuit board.

The recessed switched test connector 300 may possess a sandwich-type construction with the mounting bracket 324 forming a first half of the recessed switched test connector 300 and a bottom plate 336 forming a second half of the recessed switched test connector 300. The bottom plate 336 is crimped onto the mounting bracket 324 via four crimping tabs (e.g., crimping tab 338). Internal components of the recessed switched test connector 300 (e.g., the electrical circuit that runs through the recessed switched test connector 300) may be compressively secured between the mounting bracket 324 and the bottom plate 336 within the recessed switched test connector 300.

Figure 4:
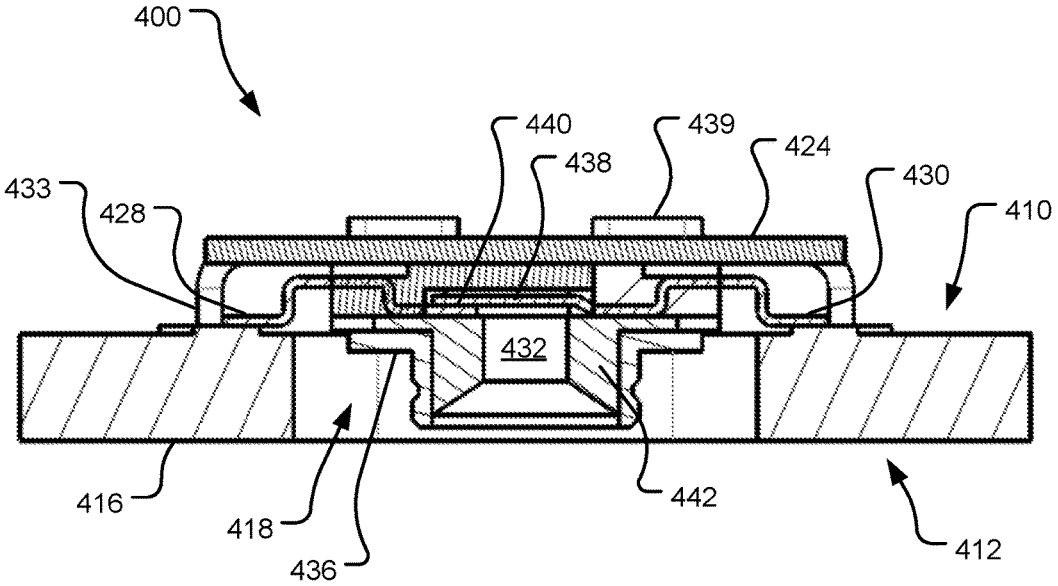
FIG. 4 is an elevation sectional view of an example recessed switched test connector.

An example sectional view of the recessed switched test connector 300 is cut along section lines B-B and illustrated as recessed switched test connector 400 of FIG. 4.

FIG. 4 is an elevation sectional view of an example recessed switched test connector 400. The recessed switched test connector 400 resides within an aperture 418 in a substrate 416 of an associated printed circuit board. The recessed switched test connector 400 protrudes beyond the substrate 416 on a component side 410 of the substrate 416, but does not substantially protrude beyond the substrate 416 (e.g., the recessed switched test connector 400 is substantially flush with an outer surface of the substrate 416 or is set back into the substrate 416) on a non-component side 412 of the substrate 416.

The recessed switched test connector 400 includes a test port 432 facing the non-component side 412 of the substrate 416. The test port 432 is used for selectively inserting a test probe (not shown, see e.g., test probe 122 of FIG. 1) to perform certification testing and analysis on the printed circuit board. The recessed switched test connector 400 is automatically activated when the test probe is inserted into the test port 432 and de-activated when the test probe is removed from the test port 432. More specifically, an electrical circuit or path runs through the recessed switched test connector 400 between tabs 428, 430 during normal operation of the printed circuit board. When the test probe is inserted into the test port 432, the test probe elastically deflects contact 438 creating an opening in the circuit at point 440 and concurrently completing a new testing circuit between the tab 430 and the test probe for performing the certification testing and analysis. When the test probe is removed from the test port, the contact 438 elastically returns to the depicted position in physical and electrical continuity with the tab 428 at point 440. In various implementations, the test port 432 includes a self-centering countersink for the associated test probe, as illustrated.

The recessed switched test connector 400 further includes a mounting bracket 424, which mounts and physically secures the recessed switched test connector 400 to the substrate 416. The mounting bracket 424 includes an array of stanchions (e.g., stanchion 433) that extend through respective holes (not shown) in the substrate 416 and may terminate with plain ends or tabs on the non-component side of the substrate 416. The tabs or plain ends of the stanchions are soldered, adhered, or mechanically fastened to the substrate 416 (on either or both of the component side 410 and the non-component side 412) and the mounting bracket 424 forms an integral part of the recessed switched test connector 400. In some implementations, the mounting bracket 424 also serves as electrical ground for the recessed switched test connector 400 and is electrically connected to ground on the printed circuit board.

In some implementations, the recessed switched test connector 400 possesses a sandwich-type construction with the mounting bracket 424 forming a first half of the recessed switched test connector 400 and a bottom plate 436 forming a second half of the recessed switched test connector 400. The bottom plate 436 is crimped onto the mounting bracket 424 via crimping tabs (e.g., crimping tab 439). Internal components of the recessed switched test connector 400 (e.g., the electrical circuit that runs through the recessed switched test connector 400) are compressively secured between the mounting bracket 424 and the bottom plate 436 within the recessed switched test connector 400.

In some implementations, the bottom plate 436 also forms a ground portion of the test port 432 allowing a ground portion of a corresponding coaxial cable extending from the test probe to be grounded directly to the recessed switched test connector 400. An insulating portion 442 of the test port 432 separates the grounded bottom plate from the electrical circuit running through the recessed switched test connector 400.

In various implementations, an impedance of the test port 432 may substantially match an impedance of the test probe, which in turn may substantially match an impedance within an associated coaxial cable. Impendence may be affected by the cross-sectional area of a central conductor and an outer conductor of each of the test probe and the coaxial cable, as well as the distance between the two conductors and the material selection for each of the conductors.

While in some implementations, view B-B of the recessed switched test connector 400 of FIG. 4 is a sectional view of the recessed switched test connector 300 of FIG. 3 cut along section lines B-B, in other implementations, the recessed switched test connector 300 of FIG. 3 and the recessed switched test connector 400 of FIG. 4 are distinct implementations with distinct features.

Figure 5:
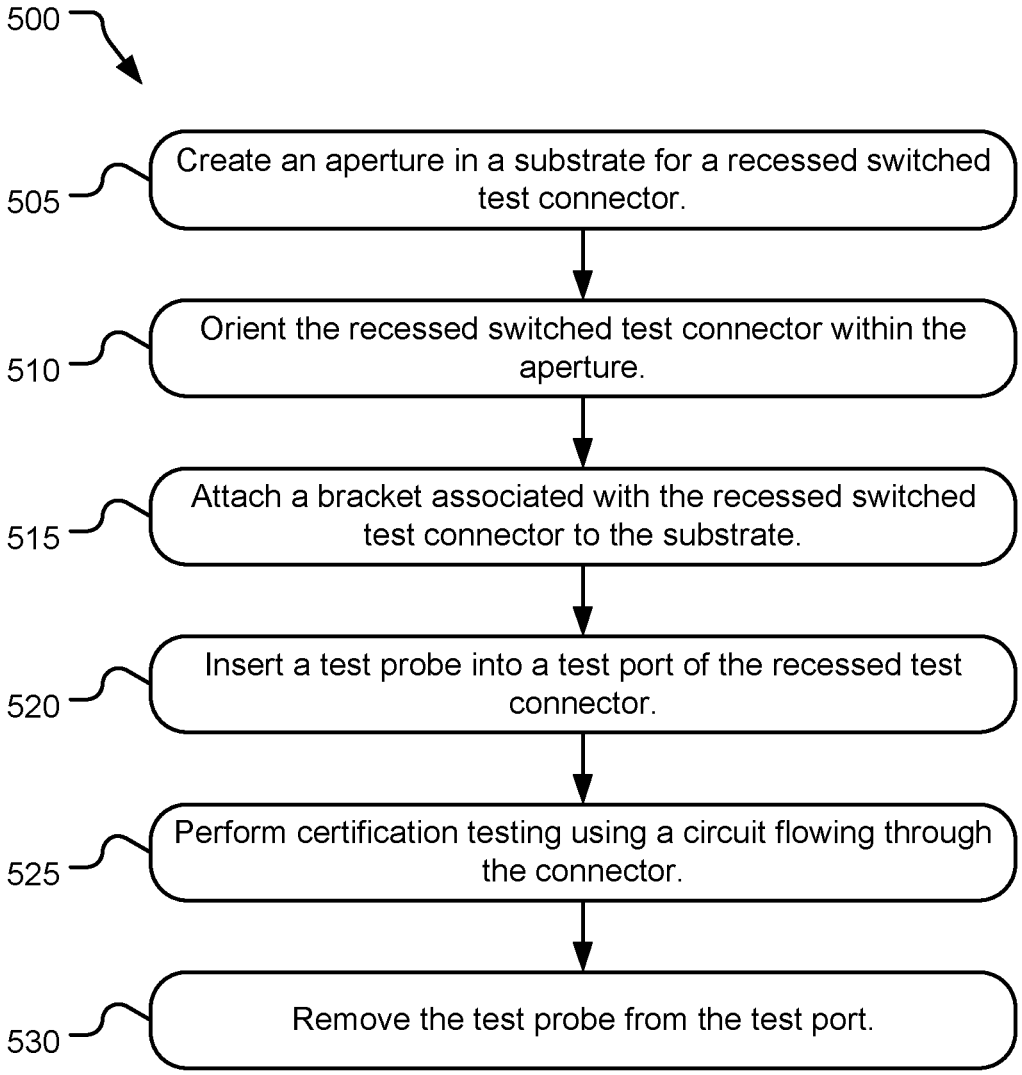
FIG. 5 illustrates example operations for installing a recessed switched test connector on a printed circuit board and using the recessed switched test connector to perform certification testing on the printed circuit board.

FIG. 5 illustrates example operations 500 for installing a recessed switched test connector on a printed circuit board and using the recessed switched test connector to perform certification testing on the printed circuit board. A creating operation 505 creates an aperture in a substrate for the recessed switched test connector. The creating operation 505 may be performed by drilling, milling, cutting, or otherwise removing material from the substrate. A size of the created aperture is defined by a size of the recessed switched test connector that will be oriented therein. The substrate forms a structure and electronic network for a variety of electronic components mounted on a component side of the printed circuit board. A non-component side of the printed circuit board includes few, if any, such electronic components.

An orienting operation 510 orients the recessed switched test connector within the aperture. The recessed switched test connector is oriented such that an associated test port faces the non-component side of the printed circuit board and is recessed within the aperture. In various implementations, a portion of the recessed switched test connector may protrude out of the component side of the printed circuit board.

An attaching operation 515 attaches a bracket associated with the recessed switched test connector to the substrate securing the recessed switched test connector in place within the aperture. In some implementations, the bracket extends through the aperture and is attached to the non-component side of the substrate. In other implementations, the bracket includes a set of stanchions that extend through dedicated holes in the substrate and are attached to either or both of the component side and the non-component side of the substrate. In various implementations, the bracket is soldered, welded, glued, or mechanically attached (e.g., screwed) to the substrate.

An inserting operation 520 inserts a test probe into a test port of the recessed switched test connector. The recessed switched test connector is automatically activated when the test probe is inserted into the test port. More specifically, an electrical circuit runs through the recessed switched test connector between two tabs or other contacts during normal operation of the printed circuit board. When the test probe is inserted into the test port, the test probe elastically deflects a contact within the recessed switched test connector creating an opening in the circuit and concurrently completing a new testing circuit between one of the tabs or contacts with the printed circuit board and the test probe. In various implementations, the test port may have a countersunk shape to guide the test probe into the test port.

A certification testing operation 525 calibrates, compliance tests (e.g., compliance with Federal Communications Commission (FCC) emissions standards), inspects for further product development, and/or interference tests a circuit connected through the recessed switched test connector. In various implementations, the testing operation 525 tests radio-frequency (RF) or other types of signals.

A removing operation 530 removes the test probe from the test port. The recessed switched test connector is automatically de-activated when the test probe is removed from the test port. More specifically, the contact within the recessed switched test connector elastically returns to its original position in physical and electrical continuity with the tab electrically connected to the printed circuit board. In various implementations, the inserting operation 520 and the removing operation 530 are selectively performed by a user or a machine during certification of the printed circuit board.

The logical operations described herein are referred to variously as operations or steps. Furthermore, the logical operations may be performed in any order, adding or omitting operations as desired, unless explicitly claimed otherwise or a specific order is inherently necessitated by the claim language.

An example printed circuit board according to the presently disclosed technology includes a printed circuit board comprising a substrate including an aperture, an array of components attached to a first side of the substrate, and a recessed switched test connector oriented within the aperture. The recessed switched test connector includes a test port accessible from a second side of the substrate and a bracket securing the recessed switched test connector within the aperture.

In another example printed circuit board according to the presently disclosed technology, the recessed switched test connector protrudes beyond the first side of the substrate.

In another example printed circuit board according to the presently disclosed technology, the array of components protrudes beyond the first side of the substrate a magnitude greater than the recessed switched test connector protrudes beyond the first side of the substrate.

In another example printed circuit board according to the presently disclosed technology, the recessed switched test connector is set back within the aperture on the second side of the substrate.

In another example printed circuit board according to the presently disclosed technology, the recessed switched test connector includes an electrical path through the printed circuit board that is mechanically and electrically disrupted when an associated test probe is inserted into the test port.

In another example printed circuit board according to the presently disclosed technology, the electrical path through the printed circuit board is mechanically and electrically restored when the associated test probe is removed from the test port.

In another example printed circuit board according to the presently disclosed technology, the test port includes a self-centering countersink for an associated test probe.

In another example printed circuit board according to the presently disclosed technology, the second side of the substrate opposes the first side of the substrate.

In another example printed circuit board according to the presently disclosed technology, the bracket serves as electrical ground for the recessed switched test connector.

In another example printed circuit board according to the presently disclosed technology, the bracket is attached to the second side of the substrate.

In another example printed circuit board according to the presently disclosed technology, the recessed switched test connector further comprises a bottom plate crimped to the bracket. An electrical circuit through the recessed switched test connector is compressively secured between the bottom plate and the bracket.

An example method of using a recessed switched test connector in a printed circuit board according to the presently disclosed technology includes inserting a test probe into a test port of the recessed switched test connector and certification testing an electrical circuit connected from the recessed switched test connector to the test probe. The recessed switched test connector is oriented within an aperture in a substrate and the recessed switched test connector is accessible from a side of the substrate opposite an array of components attached to the substrate.

Another example method of using a recessed switched test connector in a printed circuit board according the presently disclosed technology further includes removing the test probe from the test port of the recessed switched test connector following the certification testing of the electrical circuit.

In another example method of using a recessed switched test connector in a printed circuit board according to the presently disclosed technology, inserting the test probe into the test port disrupts an electrical circuit connected through the recessed switched test connector and connects the test probe to the electrical circuit.

In another example method of using a recessed switched test connector in a printed circuit board according to the presently disclosed technology, removing the test probe from the test port restores the electrical circuit connected through the recessed switched test connector and disconnects the test probe from the electrical circuit.

In another example method of using a recessed switched test connector in a printed circuit board according to the presently disclosed technology, the recessed switched test connector is recessed within the aperture on the side of the substrate opposite the array of printed circuit board components attached to the substrate.

In another example method of using a recessed switched test connector in a printed circuit board according to the presently disclosed technology, inserting the test probe into the test port further includes directly grounding the test probe to the recessed switched test connector.

An example computing device according to the presently disclosed technology includes a printed circuit board. The printed circuit board includes a substrate including an aperture, an array of components attached to a first side of the substrate, and a recessed switched test connector oriented within the aperture. The recessed switched test connector includes a test port accessible from a second side of the substrate and a bracket securing the recessed switched test connector within the aperture. The computing device also includes a display residing in close proximity to the first side of the substrate and a case residing in close proximity to the second side of the substrate. The case includes a test aperture axially aligned with the test port permitting access to the test port from outside the computing device.

Another example computing device according to the presently disclosed technology further includes a test probe for selective insertion into the test port. The test probe is connected to a coaxial cable and an impedance of the test probe substantially matches an impedance of the coaxial cable.

Another example computing device according to the presently disclosed technology further includes a test probe for selective insertion into the test port. The test probe is grounded directly to the recessed switched test connector when inserted into the test port.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A printed circuit board comprising:

a substrate including an aperture;

an array of components attached to a first side of the substrate; and a recessed switched test connector oriented within the aperture, wherein the recessed switched test connector includes:

a test port accessible from a second side of the substrate;

a bracket securing the recessed switched test connector within the aperture; and a contact to elastically deflect and electrically open an electrical path through the printed circuit board when an associated test probe is inserted into the test port.

2. The printed circuit board of claim 1, wherein the recessed switched test connector protrudes beyond the first side of the substrate.

3. The printed circuit board of claim 2, wherein the array of components protrudes beyond the first side of the substrate a magnitude greater than the recessed switched test connector protrudes beyond the first side of the substrate.

4. The printed circuit board of claim 1, wherein the recessed switched test connector is set back within the aperture on the second side of the substrate.

5. The printed circuit board of claim 1, wherein the electrical path through the printed circuit board is restored when the associated test probe is removed from the test port.

6. The printed circuit board of claim 1, wherein the test port includes a self-centering countersink for the test probe.

7. The printed circuit board of claim 1, wherein the second side of the substrate opposes the first side of the substrate.

8. The printed circuit board of claim 1, wherein the bracket serves as electrical ground for the recessed switched test connector.

9. The printed circuit board of claim 1, wherein the bracket is attached to the second side of the substrate.

10. The printed circuit board of claim 1, wherein the recessed switched test connector further comprises:

a bottom plate crimped to the bracket, wherein the electrical path through the recessed switched test connector is compressively secured between the bottom plate and the bracket.

11. A method of using a recessed switched test connector in a printed circuit board comprising:

inserting a test probe into a test port of the recessed switched test connector, the recessed switched test connector oriented within an aperture in a substrate, and the recessed switched test connector accessible from a side of the substrate opposite an array of components attached to the substrate, whereby a contact elastically deflects and electrically opens when the test probe is inserted into the test port; and certification testing an electrical circuit connected from the recessed switched test connector to the test probe.

12. The method of claim 11, further comprising:

removing the test probe from the test port of the recessed switched test connector following the certification testing of the electrical circuit.

13. The method of claim 12, wherein removing the test probe from the test port restores the electrical path through the printed circuit board and disconnects the test probe from the electrical circuit.

14. The method of claim 11, wherein inserting the test probe into the test port connects the test probe to the electrical circuit.

15. The method of claim 11, wherein the recessed switched test connector is recessed within the aperture on the side of the substrate opposite the array of printed circuit board components attached to the substrate.

16. The method of claim 11, wherein inserting the test probe into the test port further includes directly grounding the test probe to the recessed switched test connector.

17. A computing device comprising:

a printed circuit board including:

a substrate including an aperture;

an array of components attached to a first side of the substrate;

a recessed switched test connector oriented within the aperture, wherein the recessed switched test connector includes:

a test port accessible from a second side of the substrate; and a bracket securing the recessed switched test connector within the aperture;

a display residing in close proximity to the first side of the substrate; and a case residing in close proximity to the second side of the substrate, wherein the case includes a test aperture axially aligned with the test port permitting access to the test port from outside the computing device.

18. The computing device of claim 17, further comprising:

a test probe for selective insertion into the test port, wherein the test probe is connected to a coaxial cable, and wherein an impedance of the test probe substantially matches an impedance of the coaxial cable.

19. The computing device of claim 17, further comprising:

a test probe for selective insertion into the test port, wherein the test probe is grounded directly to the recessed switched test connector when inserted into the test port.

* * * * *